US012305879B2

(12) United States Patent
Vinnakota et al.

(10) Patent No.: US 12,305,879 B2
(45) Date of Patent: May 20, 2025

(54) CAMBERED LOUVERS

(71) Applicant: Carrier Corporation, Palm Beach Gardens, FL (US)

(72) Inventors: Vinay Kumar Vinnakota, Telangana (IN); Asad M. Sardar, Avon, IN (US); Pratap Kumar Dvs, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 834 days.

(21) Appl. No.: 16/908,308

(22) Filed: Jun. 22, 2020

(65) Prior Publication Data

US 2021/0003312 A1 Jan. 7, 2021

(30) Foreign Application Priority Data

Jul. 2, 2019 (IN) ..... 201911026528

(51) Int. Cl.

| | |
|---|---|
| ***F24F 13/08*** | (2006.01) |
| ***F24F 1/56*** | (2011.01) |
| ***F24F 11/46*** | (2018.01) |
| ***F24F 13/20*** | (2006.01) |

(52) U.S. Cl.

CPC ..... *F24F 13/082* (2013.01); *F24F 1/56* (2013.01); *F24F 11/46* (2018.01); *F24F 13/20* (2013.01)

(58) Field of Classification Search

CPC .. F24F 1/0011; F24F 1/56; F24F 13/06; F24F 13/08; F24F 13/082; F24F 13/20; F24F 13/24; F24F 11/46; F04D 29/667; F04D 29/703

See application file for complete search history.

(56) References Cited

U.S. PATENT DOCUMENTS

| | | | | |
|---|---|---|---|---|
| 2,920,464 | A | 1/1960 | Trask | |
| 4,330,047 | A | 5/1982 | Ruspa et al. | |
| 4,976,115 | A | 12/1990 | Hogan | |
| 7,269,965 | B2 | 9/2007 | Kim et al. | |
| 7,275,388 | B2 | 10/2007 | Joo et al. | |
| 9,393,510 | B2 | 7/2016 | MacDonald et al. | |
| 2008/0153409 | A1* | 6/2008 | Koop | B01F 3/02 454/261 |

(Continued)

FOREIGN PATENT DOCUMENTS

| | | | |
|---|---|---|---|
| CN | 1083558 | C | 4/2002 |
| CN | 2669059 | Y | 1/2005 |

(Continued)

*Primary Examiner* — Edelmira Bosques
*Assistant Examiner* — Michael James Giordano
(74) *Attorney, Agent, or Firm* — CANTOR COLBURN LLP

(57) ABSTRACT

Aspects of the invention are directed towards apparatus with cambered louvers. One or more embodiments of the invention describe a louver comprising a plurality of slats arranged in a vertical direction or a horizontal direction; and each of the slats in the louver comprise a leading edge, a trailing edge opposite to the leading edge, and a chord line connecting the leading edge with the trailing edge. Further, each of the slats in the louver has a cambered profile, wherein the cambered profile includes a camber distance varying in the range of about 20%-30% from the leading edge and a camber height varying in the range of about 5%-15% of a total camber height.

14 Claims, 7 Drawing Sheets

(56) References Cited

U.S. PATENT DOCUMENTS

2019/0353391 A1* 11/2019 Klauer ..... F24F 1/50

FOREIGN PATENT DOCUMENTS

| | | | | |
|---|---|---|---|---|
| CN | 202732505 | U | * | 2/2013 |
| CN | 105485882 | A | | 4/2016 |
| CN | 205783641 | U | | 12/2016 |
| CN | 107860107 | A | | 3/2018 |
| CN | 207702687 | U | | 8/2018 |
| EP | 0905455 | A1 | | 3/1999 |
| EP | 1886070 | B1 | | 2/2008 |
| JP | 9068344 | A | | 3/1997 |
| JP | 2007163021 | A | * | 6/2007 |
| JP | 2008096037 | A | * | 4/2008 |
| KR | 199770821 | A | | 11/1997 |
| KR | 100191722 | B1 | | 6/1999 |
| KR | 101086355 | B1 | | 11/2011 |
| KR | 101593987 | B1 | | 2/2016 |

* cited by examiner

CAMBERED LOUVERS

FOREIGN PRIORITY

This application claims priority to Indian Patent Application No. 201911026528, filed Jul. 2, 2019, and all the benefits accruing therefrom under 35 U.S.C. § 119, the contents of which in its entirety are herein incorporated by reference.

TECHNICAL FIELD OF INVENTION

The present invention relates generally to louvers. More particularly, the invention relates to cambered louver in air flow systems.

BACKGROUND OF THE INVENTION

Currently, there are numerous outdoor units or condensing units available in the market for commercial and residential purpose. Such outdoor units or condensing units include grills or louver panels. The grills present in the outdoor units or condensing units are wire grills. In the wire grills, the hail guard protection is lost. Further, the louver panels in the outdoor/condensing units are flat or straight-angled louver panels. These straight-angled louver panels cause air flow loss in the outdoor/condensing unit due to drag pressure/force. The loss of air flow results in high differential pressure across the outdoor/condensing units and affects the performance of the condensing units.

In addition, these existing grills or flat/straight-angled louver panels in the outdoor/condensing units are unable to provide protection from any damage, hail storm, or dust. Due to the failure in providing any protection, the existing grills or flat/straight-angled louver panels are required to be upgraded. Moreover, the designers of these units as well as the buyers are leaning towards outdoor/condensing units with the louver panels instead of wire grills. The reason for such preference is better aesthetics without compromising on performance of these units.

In order to prevent the air flow losses in the outdoor/condensing units and also to maintain pressure across the outdoor/condensing units, an apparatus with cambered louvers is required. In addition, there is a need of an apparatus with cambered louvers, which can prevent air flow losses and maintain pressure across the outdoor/condensing units. There is also a requirement of an apparatus with cambered louvers which provides protection from any damage, downtime, hail storm, or dust.

SUMMARY OF THE INVENTION

Various embodiments of the invention describe a louver comprising a plurality of slats arranged in a vertical direction or a horizontal direction. The invention also describes that each of the slats in the louver comprise a leading edge, a trailing edge opposite to the leading edge, and a chord line connecting the leading edge with the trailing edge camber distance camber height. Further, each of the slats in the louver has a cambered profile, wherein the cambered profile includes a camber distance varying in the range of about 20%-30% from the leading edge and a camber height varying in the range of about 5%-15% of a total camber height.

In an embodiment of the invention, the camber distance is configured at about 20% from the leading edge and the camber height is configured at about 10% of the total camber height.

In an alternative embodiment of the invention, the camber distance is configured at about 20% from the leading edge and the camber height is configured at about 5% of the total camber height.

In another alternative embodiment of the invention, the camber distance is configured at about 20% from the leading edge and the camber height is configured at about 15% of the total camber height.

In yet another alternative embodiment of the invention, the camber distance is configured at about 25% from the leading edge and the camber height is configured at about 10% of the total camber height.

In further alternative embodiment of the invention, the camber distance is configured at about 25% from the leading edge and the camber height is configured at about 5% of the total camber height.

In another alternative embodiment of the invention, the camber distance is configured at about 25% from the leading edge and the camber height is configured at about 15% of the total camber height.

In a different embodiment of the invention, the camber distance is configured at about 30% from the leading edge and the camber height is configured at about 5% of the total camber height.

In another embodiment of the invention, the camber distance is configured at about 30% from the leading edge and the camber height is configured at about 10% of the total camber height.

In yet another embodiment of the invention, the camber distance is configured at about 30% from the leading edge and the camber height is configured at about 15% of the total camber height.

In a further embodiment of the invention, each of the slats is positioned with respect to a setting angle and the setting angle depends on the camber distance and the camber height. The setting angle is varied between about 45 degree and about 65 degree.

In an embodiment of the invention, the louver is configured to fit on at least one side of an air-conditioner unit.

In a different embodiment of the invention, there is a predetermined spacing between each of the plurality of slats in the louver.

In yet another embodiment of the invention, the cambered profile is configured to improve performance of an outdoor unit and improve energy efficient ratio of an outdoor unit. Further, the cambered profile is configured to reduce differential pressure across an outdoor unit.

This summary is provided to introduce a selection of concepts in a simplified form, from those that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION

Described herein is an apparatus having a louver, wherein the louver comprises a plurality of slats arranged in a vertical direction and/or a horizontal direction. The invention also describes that each of the slats in the louver comprise a leading edge, a trailing edge opposite to the leading edge, and a chord line connecting the leading edge with the trailing edge. Further, each of the slats in the louver has a cambered profile, the cambered profile includes a camber distance and a camber height. Particularly, the camber distance may vary in the range of about 20%-30% from the leading edge and a camber height may vary in the range of about 5%-15% of a total camber height.

Figure 1:
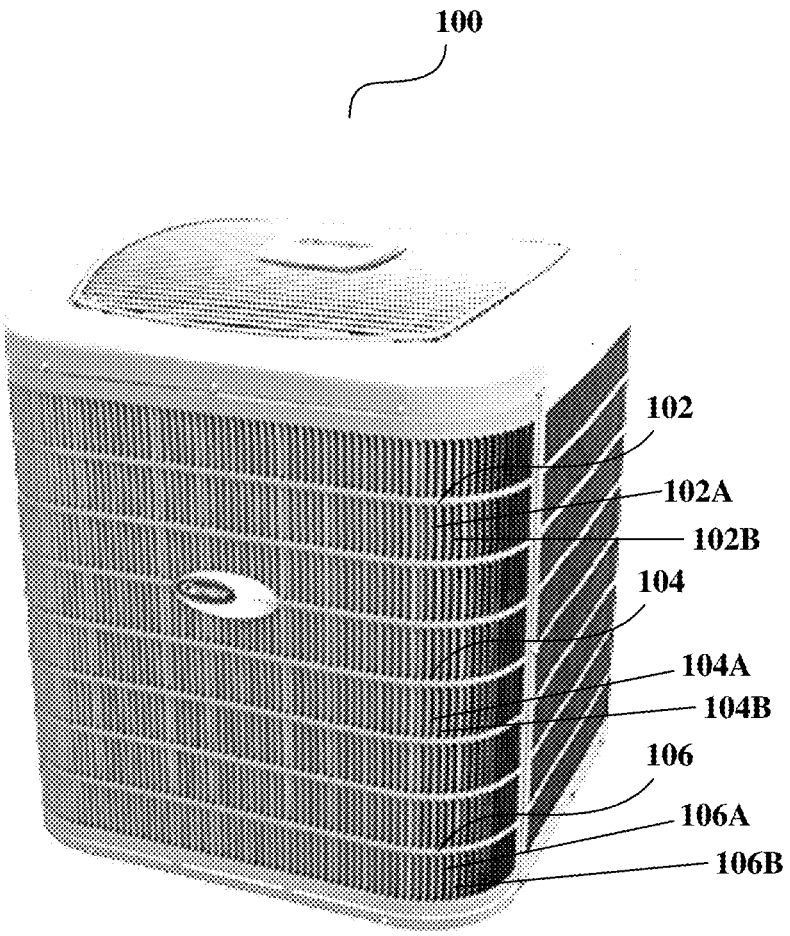
FIG. 1 depicts an exemplary apparatus with louver having slats, according to an exemplary embodiment of the invention.

FIG. 1 depicts an exemplary apparatus 100 with a plurality of louvers 102/104/106. As depicted in FIG. 1, the louvers 102/104/106 in the apparatus 100 are arranged in a horizontal direction. Each of the louvers 102/104/106 comprises a plurality of slats. As can be seen in FIG. 1, slats 102A/102B in the louver 102 are arranged in a vertical direction. Similarly, slats 104A/104B present in the louver 104 are arranged in a vertical direction. Also, slats 106A/106B in the louver 106 are also arranged in a vertical direction. Each of the slats A/B in the louver 102/104/106 comprise a leading edge, a trailing edge opposite to the leading edge, and a chord line connecting the leading edge with the trailing edge. Further, each of the slats in the louver has a cambered profile, wherein the cambered profile includes a camber distance varying in the range of about 20%-30% from the leading edge and a camber height varying in the range of about 5%-15% of a total camber height. This has been explained in details in FIG. 3. In an exemplary embodiment, the louvers 102/104/106 are configured to fit on all four sides of the apparatus 100. In another exemplary embodiment, the louvers 102/104/106 are configured to fit on a top side of the apparatus 100. In a further exemplary embodiment, the apparatus 100 can be an air-conditioner unit or a cooler unit having louvers.

Figure 2:
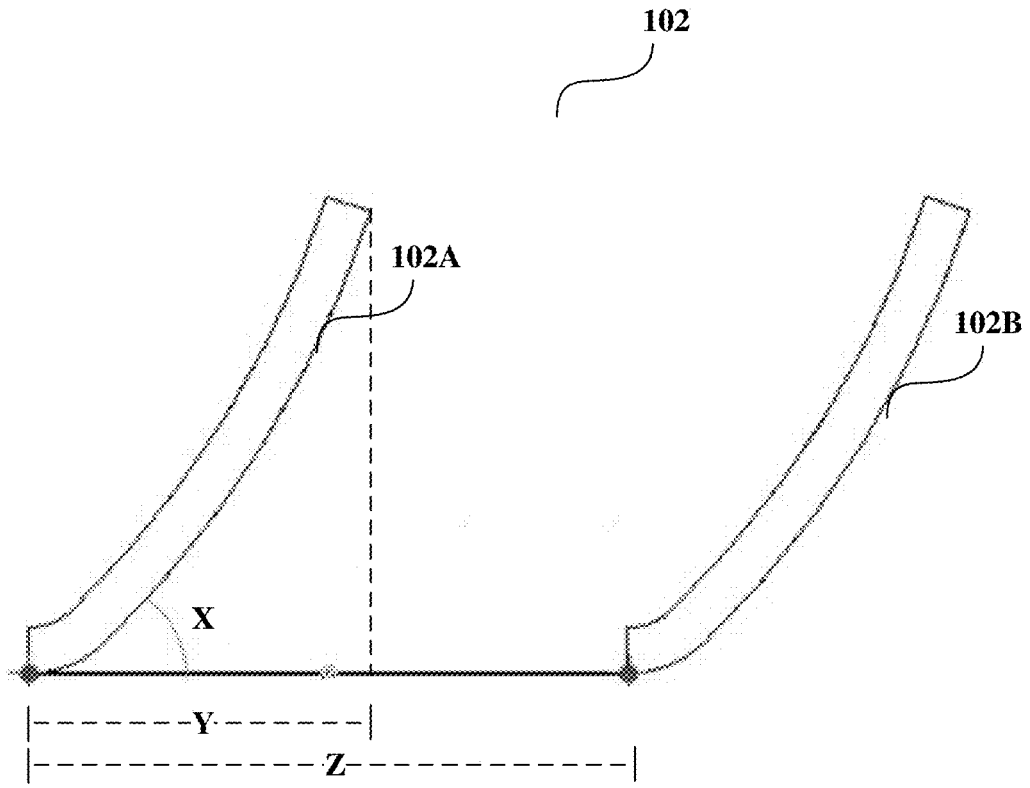
FIG. 2 depicts exemplary slats in a louver according to an exemplary embodiment of the invention

FIG. 2 depicts an exemplary slats 102A/102B in a louver 102, according to an exemplary embodiment of the invention. The slat 102A in the louver 102 is separated from the other slat 102B in the louver 102 and is positioned at a distance Z from the other slat 102B. Also, the slat 102A in the louver 102 is positioned at an angle X (in degrees) and projection of the slat 102A is positioned at a distance Y of a total distance Z.

Figure 3:
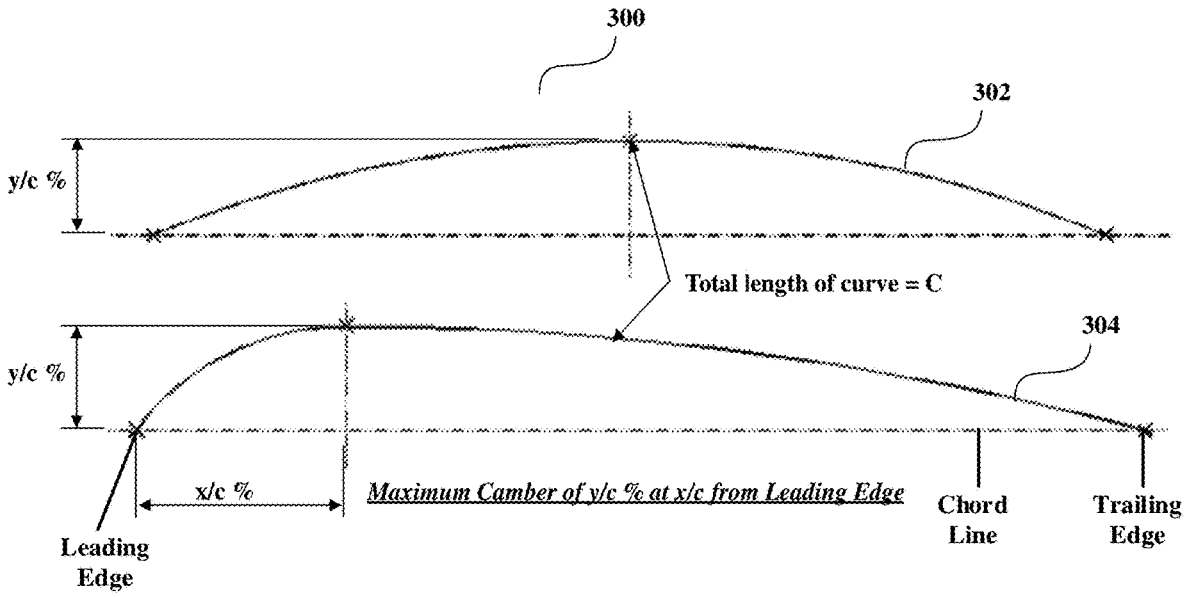
FIG. 3 depicts exemplary graphs illustrating camber curve according to an exemplary embodiment of the invention.

FIG. 3 depicts exemplary graphs 300 illustrating camber curves according to an exemplary embodiment of the invention. Graph 302 depicts a circular arc showing a total length of camber curve, C on a horizontal axis and a y/c % on a vertical axis. The y/c % corresponds to a height of the camber curve or also called as camber height. The graph 302 represents a scenario where the cambered profile has a distance from the leading edge at the center. That is, the maximum camber is present in the middle of the curve.

In contrast, graph 304 depicts an arc showing a total length of camber curve, C. The graph 304 also depicts a camber distance on a horizontal axis and a camber height on a vertical axis. The camber distance is measured from a leading edge (as depicted in left corner of graph 304) and is designated as x/c % from the leading edge. It is to be noted that the maximum camber in this case is present near the leading edge. The camber height is height of maximum camber designated as y/c %. The various possibilities of different values of the camber distance and the camber height are explained in FIG. 5. As can be seen, a chord line connects the leading edge with a trailing edge (as depicted in right corner of graph 304) in exemplary graph 304.

Figure 4:
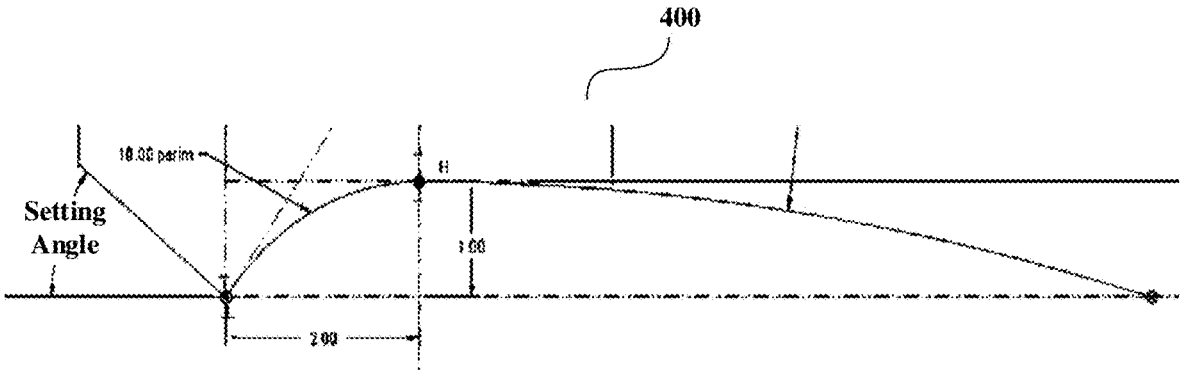
FIG. 4 depicts an exemplary graph illustrating a setting angle in camber curve according to an exemplary embodiment of the invention.

FIG. 4 is an exemplary graph illustrating a setting angle in camber curve according to an exemplary embodiment of the invention. As depicted in the FIG. 4, the exemplary graph 400 is plotted when the value of the camber distance (x/c %) is configured at about 20% from the leading edge and the value of the camber height (y/c %) is configured at about 10% of total camber height. As used herein, the setting angle of the camber curve is measured in degrees and is the angle between the x-axis and the orthogonal line to the tangent at the leading edge of the cambered curve. In an exemplary embodiment, the setting angle is varied between about 45 degrees and about 65 degrees.

Figure 5:
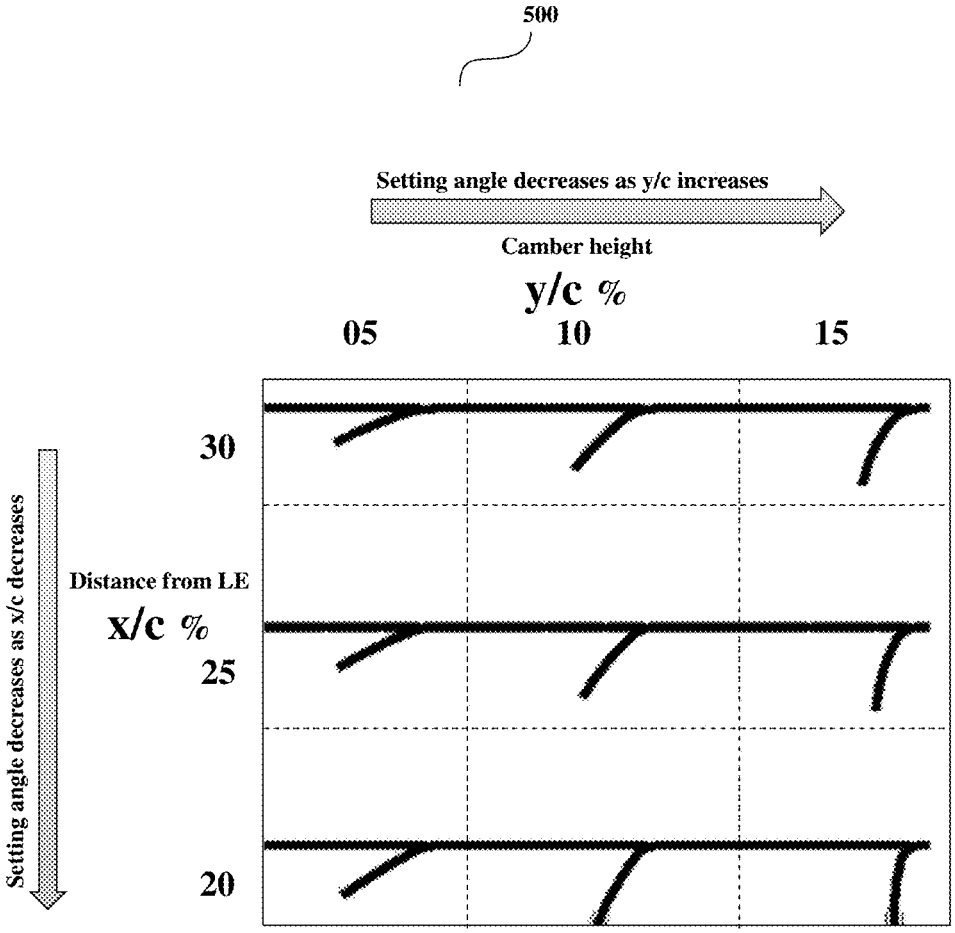
FIG. 5 depicts exemplary graphs illustrating multiple cambered profiles according to an exemplary embodiment of the invention.

FIG. 5 is an exemplary multiple cambered profiles according to an exemplary embodiment of the invention. As seen in the graph 500, nine cambered profile have been shown. For instance, the first cambered profile (at top left) includes the camber distance (x/c %) which is configured at about 30% from the leading edge and the camber height (y/c %) configured at about 5% of total camber height. The first cambered profile has a setting angle of about 71.08 degrees. The second cambered profile (at top middle) includes the camber distance (x/c %) which is configured at about 30% from the leading edge and the camber height (y/c %) configured at about 10% of total camber height. The second cambered profile has a setting angle of about 53.13 degrees. Also, the third cambered profile (at top right) includes the camber distance (x/c %) which is configured at about 30% from the leading edge and the camber height (y/c %) configured at about 15% of total camber height. The third cambered profile has a setting angle of about 36.87 degrees.

Similarly, the fourth cambered profile (at middle left) includes the camber distance (x/c %) which is configured at about 25% from the leading edge and the camber height (y/c %) configured at about 5% of total camber height and with a setting angle of about 67.38 degrees. The fifth cambered profile (at middle center) includes the camber distance (x/c %) which is configured at about 25% from the leading edge and the camber height (y/c %) is configured at about 10% of total camber height and with a setting angle of about 46.40 degrees. Also, the sixth cambered profile (at middle right) includes the camber distance (x/c %) which is configured at about 25% from the leading edge and the camber height (y/c %) configured at about 15% of total camber height and with a setting angle of about 28.07 degrees.

Likewise, the seventh cambered profile (at bottom left) includes the camber distance (x/c %) which is configured at about 20% from the leading edge and the camber height (y/c %) configured at about 5% of total camber height. The eighth cambered profile (at bottom middle) includes the camber distance (x/c %) which is configured at about 20% from the leading edge and the camber height (y/c %) configured at about 10% of total camber height. Also, the ninth cambered profile (at bottom right) includes the camber distance (x/c %) which is configured at about 20% from the leading edge and the camber height (y/c %) configured at about 15% of total camber height. The setting angle for the seventh cambered profile, eighth cambered profile and ninth cambered profile is about 61.93 degrees, about 36.87 degrees and about 16.26 degrees, respectively.

Each of these exemplary nine cambered profiles shows its respective camber curve at different values of the camber distance (x/c %) from the leading edge and the camber height (y/c %) of total camber height. Also, as can be seen, the setting angle decreases as the value of the camber distance (x/c %) decreases. Also, the setting angle decreases as the value of the camber height (y/c %) increases. Overall, by varying the values of the camber distance (x/c %) and the camber height (y/c %), different cambered profiles can be generated. The various values of the camber distance (x/c %) from the leading edge and the camber height (y/c %) of total camber height in different cambered profiles are cumulated in the exemplary Table 1 below. As can be seen, the camber distance (x/c %) varies in the range of about 20%-30% from the leading edge and the camber height varies in the range of about 5%-15% of a total camber height. Although the Table 1 shows nine exemplary cambered profiles at different values of the camber distance (x/c %) from the leading edge and the camber height (y/c %) of total camber height; however, it is appreciated by a person skilled in the art, that any number of cambered profiles can be achieved by varying values of the camber distance (x/c %) from the leading edge and the camber height (y/c %) of total camber height. Moreover, the cambered profile is configured to improve performance of an outdoor unit and improve energy efficient ratio of an outdoor unit. Further, the cambered profile is configured to reduce differential pressure across an outdoor unit.

TABLE 1

| Cambered Profile | Camber distance (x/c %) | Camber height (y/c %) | Setting Angle |
|---|---|---|---|
| Cambered Profile 1 | 30 | 05 | 71.08 |
| Cambered Profile 2 | 30 | 10 | 53.13 |
| Cambered Profile 3 | 30 | 15 | 36.87 |
| Cambered Profile 4 | 25 | 05 | 67.38 |
| Cambered Profile 5 | 25 | 10 | 46.40 |
| Cambered Profile 6 | 25 | 15 | 28.07 |
| Cambered Profile 7 | 20 | 05 | 61.93 |
| Cambered Profile 8 | 20 | 10 | 36.87 |
| Cambered Profile 9 | 20 | 15 | 16.26 |

Figure 6:
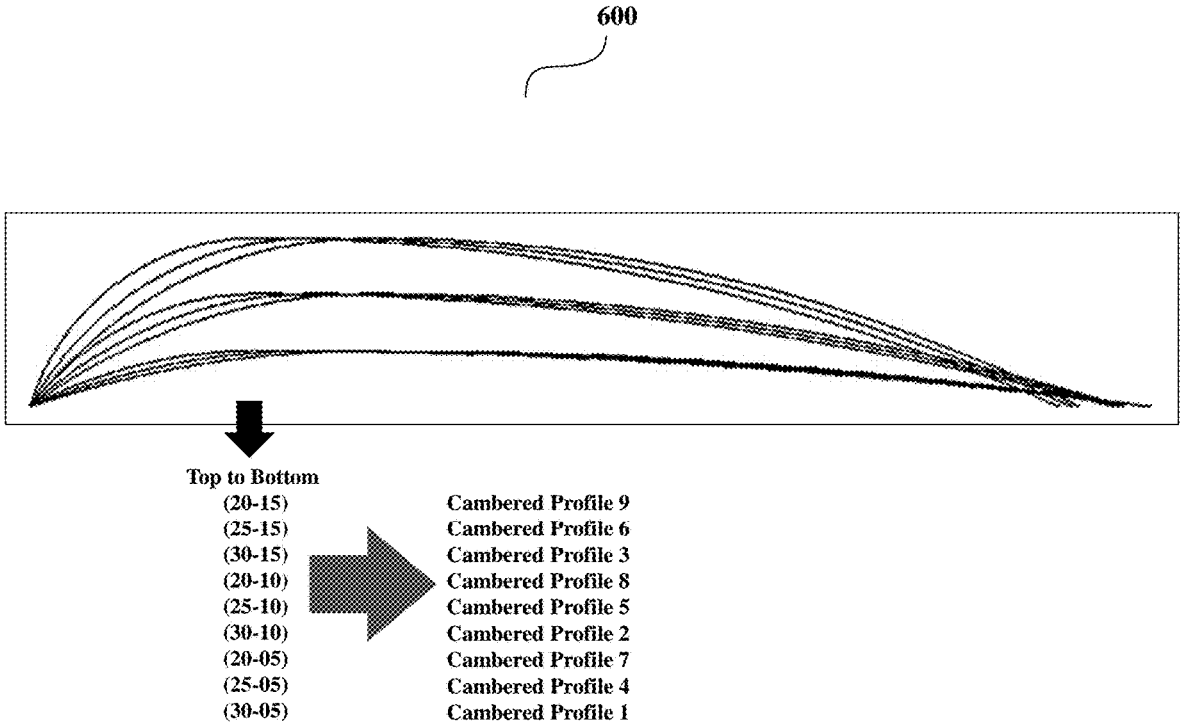
FIG. 6 depicts exemplary graphs illustrating multiple camber curves of cambered profiles according to an exemplary embodiment of the invention.

FIG. 6 is an exemplary multiple camber curves of cambered profiles according to an exemplary embodiment of the invention. FIG. 6 represents nine camber curves for each of the exemplary nine cambered profiles at different values of the camber distance (x/c %) of from the leading edge and the camber height (y/c %) of total camber height as explained in FIG. 5 and Table 1 above. As depicted, the top three camber curves represents the cambered profiles 9, 6 and 3, the middle three camber curves represents the cambered profiles 8, 5 and 2 and the bottom three camber curves represents the cambered profiles 7, 4 and 1, respectively.

Figure 7:
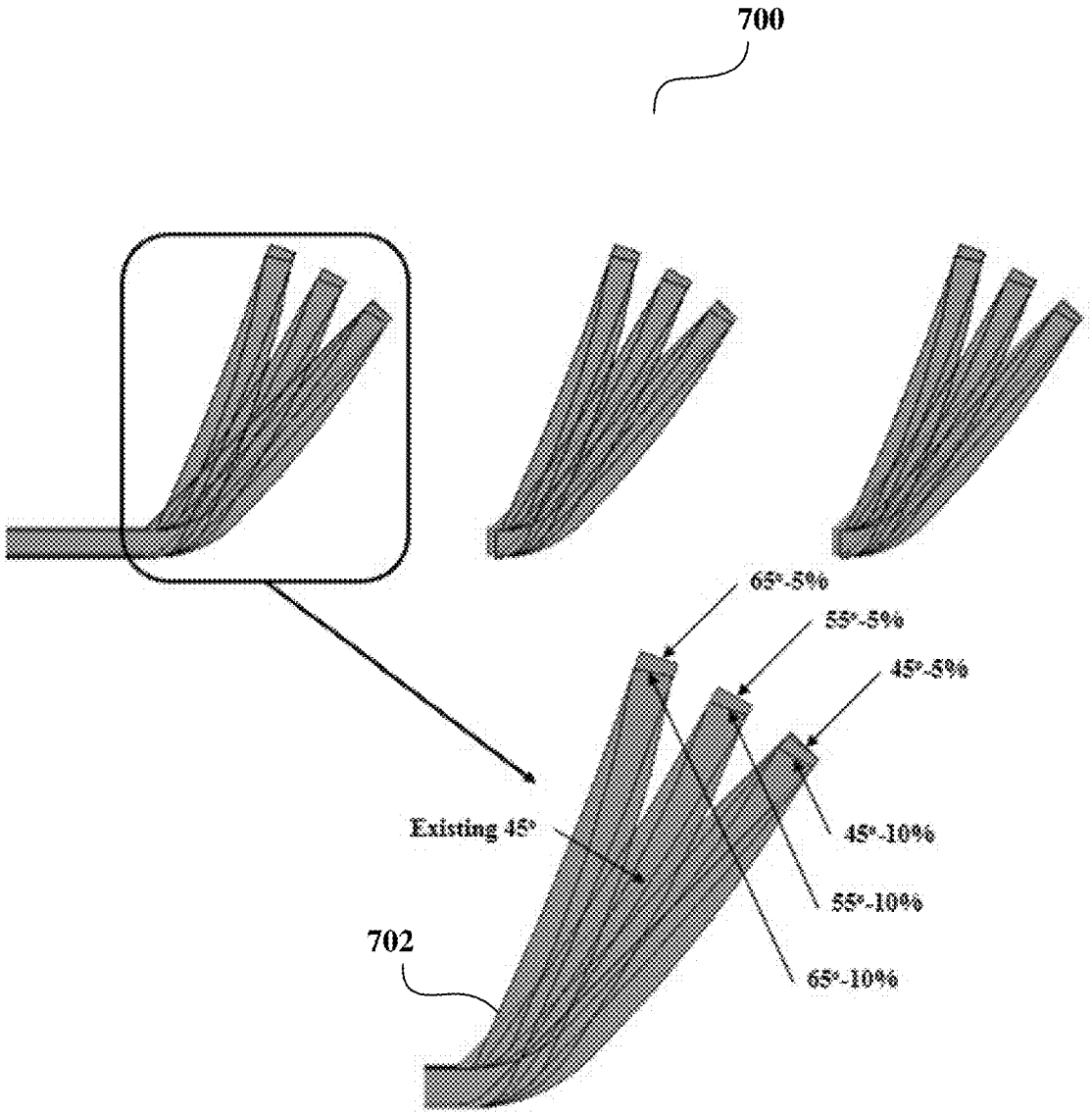
FIG. 7 depicts an exemplary cambered louvers including cambered profiles according to an exemplary embodiment of the invention.

FIG. 7 is an exemplary cambered slats in the louvers includes cambered profile, according to an exemplary embodiment of the invention. Reference numeral 702 depicts comparison between an existing slat with 45 degree of setting angle (in red color) and other slats designed in accordance with exemplary cambered profile with setting angle varied from about 45 degrees to about 65 degrees. That is, the slats are positioned with respect to a setting angle, wherein the setting angle is varied between about 45 degrees and about 65 degrees.

The present invention provides the following technical advantages over the existing apparatus: a) replaces existing wire grills and provides same performance without redesigning coil (i.e. Heat exchanger) or compressor, b) usage of aerodynamic louver design that has a cambered profile, specific setting angles and louver spacing, c) promotes earlier transition from laminar flow to turbulent flow that causes, first an acceleration and then a deceleration of flow (i.e. an adverse pressure gradient) on the upper surface of louver, d) results in delayed flow separation from the upper surface of the louver which reduces pressure drag. e) generates multiple cambered profiles based on airfoil parameters such as setting angle, camber distance, and camber height, f) prevents the air flow losses in the outdoor/condensing units, g) maintains pressure across the outdoor/condensing units, h) provides protection from any damage, downtime, hail storm, or dust, i) results in lower pressure losses across the louver which reduces overall loss factor, j) improves the performance and Energy Efficient Ratio (EER) ratings of the outdoor/condensing unit, and k) improves the aesthetics of outdoor/condensing units.

The embodiment of the invention discussed herein is exemplary and various modifications and alterations to a person skilled in the art are within the scope of the invention.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C".

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A louver comprising:

a plurality of slats arranged in a vertical direction or a horizontal direction;

each of the slats in the louver comprise a leading edge, a trailing edge opposite to the leading edge, a chord line connecting the leading edge with the trailing edge; and each of the slats in the louver has a cambered profile, wherein the cambered profile includes a camber distance varying in the range of about 20%-25% from the leading edge and a camber height located at the camber distance, the camber height varying in the range of about 5%-15% of a total length of the cambered profile.

2. The louver of claim 1, wherein the camber distance is configured at about 20% from the leading edge and the camber height is configured at about 10% of the total length of the cambered profile.

3. The louver of claim 1, wherein the camber distance is configured at about 20% from the leading edge and the camber height is configured at about 5% of the total length of the cambered profile.

4. The louver of claim 1, wherein the camber distance is configured at about 20% from the leading edge and the camber height is configured at about 15% of the total length of the cambered profile.

5. The louver of claim 1, wherein the camber distance is configured at about 25% from the leading edge and the camber height is configured at about 10% of the total length of the cambered profile.

6. The louver of claim 1, wherein the camber distance is configured at about 25% from the leading edge and the camber height is configured at about 5% of the total length of the cambered profile.

7. The louver of claim 1, wherein the camber distance is configured at about 25% from the leading edge and the camber height is configured at about 15% of the total length of the cambered profile.

8. The louver of claim 1, wherein each of the slat is positioned with respect to a setting angle, wherein the setting angle depends on the camber distance and the camber height.

9. The louver of claim 8, wherein the setting angle varies between about 45 degrees and about 65 degrees.

10. The louver of claim 1, wherein the louver is configured to fit on at least one side of an air-conditioner unit.

11. The louver of claim 1, wherein there is a predetermined spacing between each of the plurality of slats in the louver.

12. The louver of claim 1, wherein the cambered profile is configured to improve performance of an outdoor unit.

13. The louver of claim 1, wherein the cambered profile is configured to improve energy efficient ratio of an outdoor unit.

14. The louver of claim 1, wherein the cambered profile is configured to reduce differential pressure across an outdoor unit.

* * * * *